United States Patent [19]

Wiech, Jr.

[11] Patent Number: 4,661,315

[45] Date of Patent: Apr. 28, 1987

[54] METHOD FOR RAPIDLY REMOVING BINDER FROM A GREEN BODY

[75] Inventor: Raymond E. Wiech, Jr., San Diego, Calif.

[73] Assignee: Fine Particle Technology Corp., Camarillo, Calif.

[21] Appl. No.: 829,306

[22] Filed: Feb. 14, 1986

[51] Int. Cl.[4] ..... B22F 1/00

[52] U.S. Cl. ..... 419/10; 264/63; 264/65; 264/125; 419/36; 419/37; 419/58; 419/65

[58] Field of Search ..... 419/10, 36, 37, 58, 419/65; 264/63, 65, 125

[56] References Cited

U.S. PATENT DOCUMENTS

| | | | |
|---|---|---|---|
| 4,056,588 | 11/1977 | Baniel et al. | 264/63 |
| 4,094,690 | 6/1978 | Morton | 264/63 |
| 4,320,074 | 3/1982 | Birchall et al. | 264/63 |
| 4,474,731 | 10/1984 | Browlow et al. | 419/5 |
| 4,595,545 | 6/1986 | Sane | 264/65 |

*Primary Examiner*—Stephen J. Lechert, Jr.
*Attorney, Agent, or Firm*—Jay M. Cantor

[57] ABSTRACT

The disclosure relates to a method of rapidly removing binder from a "green" body composed of metal or cermet fine particles and a carbon-containing binder wherein the debinderizing step is performed in a water saturated atmosphere to provide chemical reaction with elemental carbon, the reaction products being removed from the system.

17 Claims, 1 Drawing Figure

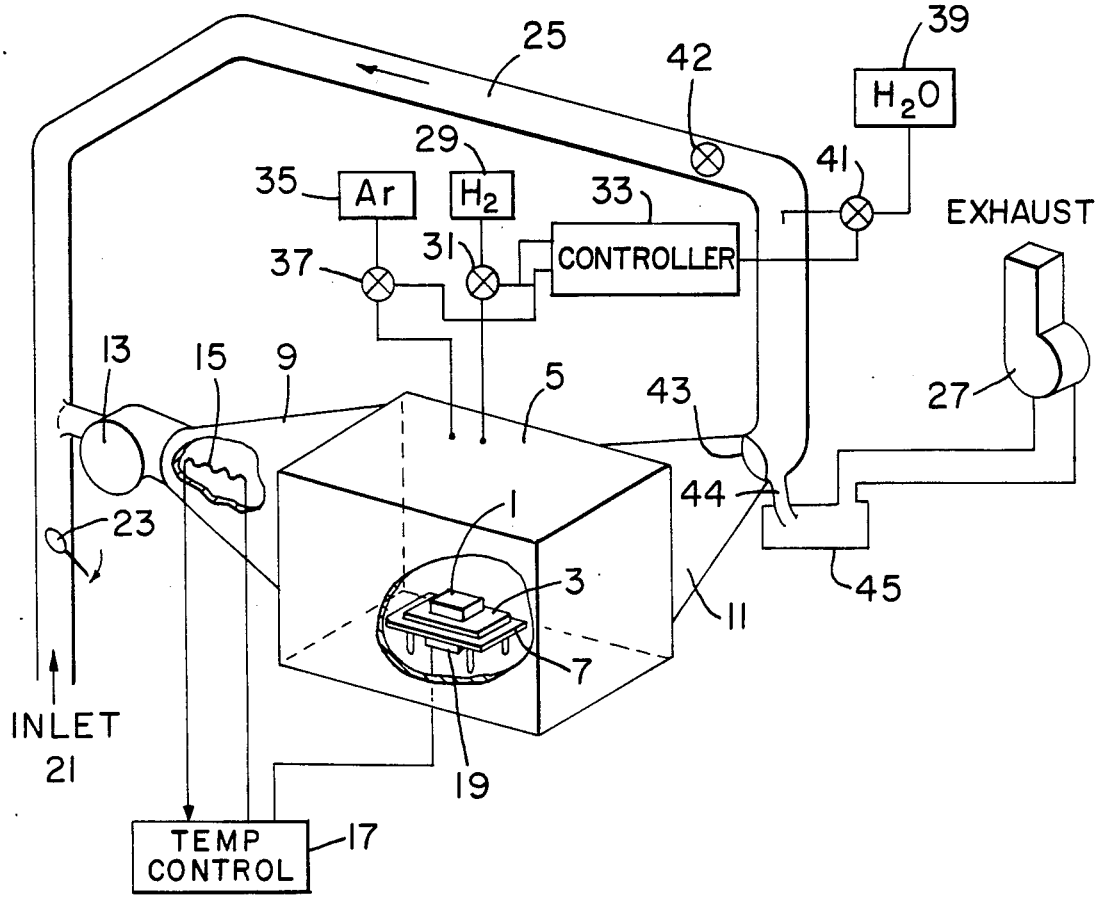
25
42
39
$H_2O$
29
41
35
Ar
$H_2$
33
EXHAUST
37
31
CONTROLLER
13
15
9
5
43
27
44
1
23
3
45
11
7
INLET
21
19
TEMP
CONTROL
17

METHOD FOR RAPIDLY REMOVING BINDER FROM A GREEN BODY

BACKGROUND OF THE INVENTION

1. Field of the Invention

This invention relates to the formation of parts from sinterable particles of material and, more specifically, to a method of rapidly removing binder from the "green" body as well as carbon formed during such binder removal in the process of formation of such parts.

2. Description of the Prior Art

The art of forming articles from particulate material is well known and examples of such systems are represented in the Strivens U.S. Pat. No. 2,939,199, Curry U.S. Pat. No. 4,011,291, Wiech, U.S. Pat. No. 4,197,116 and Wiech, U.S. Pat. No. 4,404,166, British Patent Nos. 779,242 and 1,516,079 as well as the European application of Wiech, Ser. No. 81100209.6, published July 22, 1981. While these prior art systems represent the gradual evolution in the art of manufacturing parts from particulate material with binder removal, the prior art has always suffered from the problem that the time required to remove the binder from the "green" body has been quite lengthy. In the formation of parts according to the procedures set forth in the above noted Wiech prior art, and probably in the other noted prior art, debinderizing and sintering have proceeded rapidly and without problem for small loads. However, as the load size increases in volume, for a given volume of oven or debinderizer, the required debinderizing time in particular and to some extent the sintering time increases. Also, a carbon deposit remains on and in the parts under high load when a carbon containing binder is used which deposit is not removed during the sintering step. It is postulated that the carbon deposit is a result of the pyrolytic decomposition of the binder during both the debinderizing step and the sintering step. However, as the load volume increases, the amount of water remaining in the system becomes inadequate to remove all carbon formed from the system by reaction therewith, thereby causing such carbon to be retained on and within the parts being formed. It is therefor desirable and, in fact, imperative that such carbon be removed from the system during the processing steps. It is also desirable that the debinderizing time be decreased to increase the efficiency and economics of the processing system. It is also desirable to reduce the effluent of the system by capturing the spent binder and/or its products of decomposition.

BRIEF DESCRIPTION OF THE INVENTION

In accordance with the present invention, the above noted problems of the prior art are overcome and there is provided a method and system whereby binder can be removed from a "green" body much more rapidly than in prior art systems, wherein the carbon formed during processing of high volume loads is removed during the processing procedure and wherein spent binder and/or its products of decomposition are captured.

Briefly, this is accomplished by providing a binder system of one or more components, preferably at least two components with different flow temperatures, homogeneously mixed with fine particles of metal, ceramic or cermet, as described, for example, in the above noted patent of Wiech U.S. Pat. No. 4,404,166, and forming a "green" body from such homogeneous mixture. The binder is then removed, preferrably in part (though all of the binder can be removed) from the "green" body by increasing the temperature within the debinderizer to a level just below the melting point of the higher melting point component of the binder to permit the evaporation and pyrolytic decomposition of the low melting point binder components, with the temperature continually being increased with soaking time at predetermined temperatures in this manner to remove all or most of the binder. It is postulated that the carbon forms during this binder removal procedure from the pyrolytic decomposition of the binder. In addition, as the temperature within the debinderizer is raised above 100° C. and preferrably in the range of 130° to 140° C., water or steam is entered into the debinderizer and preferrably in the path of the recirculating atmosphere where water vapor is formed, in the case of water entry, to gradually saturate the atmosphere within the debinderizer with water. During this portion of the procedure, a very small amount of oxide will form on the surfaces of the fine particles and cause a very small amount of welding and possibly diffusion of the fine particles to and into each other. Also, substantially all of the carbon formed is removed by the reaction of the binder and the water which substantially saturates the atmosphere. Normally, substantially all of the binder is removed in this step and the particles are held together, primarily by the oxide formed on the surfaces of the particles during the debinderizing operation.

In the case of a two oven system, the debinderizing oven will now be turned off and the parts will be allowed to cool down to the point where they can be handled without reaction and placed in a sintering oven. In the case of a single oven being utilized for the entire process, the procedure will continue in the same manner as will be described hereinbelow for the two oven system except that the parts will remain in the oven without the cooldown.

The water now continues to enter into the one unit system, preferably only for those materials wherein easily reducible oxides are not present on the part along with argon whereas argon gas now enters the second unit of the two unit system, in both cases the argon being preferrably bubbled through the entering water with the temperature being raised to above the melting point of the entire binder system. At this temperature, hydrogen, in addition to the water and argon, is gradually entered into the system with the atmosphere being substantially saturated with the water vapor. The temperature is then raised to a level below the sintering temperature of the fine particles involved and held at that temperature, preferrably about 735° C., with the amount of hydrogen in the system being increased to about 60% by volume of the total atmosphere. The system is permitted to stay at this elevated temperature to provide removal of all of the remaining carbon formed by the pyrolytic decomposition of the remaining binder, some of the binder also going off by evaporation. When the system has about 60% hydrogen therein by volume, the hydrogen and argon sources are controlled so that a fixed flow rate of hydrogen and argon mix is maintained. For a single pass system, this is accomplished by supplying metered hydrogen and argon to a gas analyzer which measures the ratio thereof and provides a signal to a computer which continually adjusts the gas ratio to the desired target point by conventional techniques. An adjustable gas flow regulator controls the amount of this gas entering the oven. The system is now permitted to soak at the elevated temperature until substantially all binder is removed after which the water source is shut off. The temperature in the system is then raised to the sintering temperature for the materials involved, this being, for example, 1250° C. for a nickel-iron system with average particle size of about 3 to 5 microns, with sintering taking place at this temperature for about one hour. The system is then shut off and permitted to cool to a temperature whereat no reaction will take place, such as about 80° C. or less. At this point, the hydrogen and argon sources are shut off and the system is opened for removal of finished sintered articles.

For materials which are much more reactive than iron (e.g., stainless steel), the initial elevated temperature will still be 735° C. after the above described soak. However, the surfaces of the particles must now be reduced to their metallic state. This is accomplished by turning off the water and, for a stainless steel system, using the prealloy or the components thereof individually, a second soak is provided with the temperature raised to 950° C. with the atmosphere being retained at a dew point of less than −40° C. for sufficient time to remove all oxides. This is accomplished by measuring effluent with a dew point meter. For these reactive materials, it is preferable to recirculate the oven effluent gas, drying it during recirculation with known drying media which will remove sufficient water from the atmosphere to permit the desired dew point to be attained, which is to dew point considerably less than the −40° C. The sintering step will then take place as described above for the iron-nickel composition. The temperature is then reduced with the dew point on the reducing side of the dew point curve for all of the materials involved in the environment involved or in oxygen. The system is so cooled to a temperature at which reaction will not take place, such as about 80° C. or less and the system is then opened.

A system has been described wherein debinderizing time is decreased to a small fraction of the time required in the prior art system for equivalent volume levels. Decreases in debinding time of up to one tenth that of the prior art have been observed. In addition, sintering times are somewhat reduced and carbon is substantially completely removed from the final articles produced.

BRIEF DESCRIPTION OF THE DRAWINGS

The FIGURE describes schematically a binder removal system in accordance with one embodiment of the present invention.

DETAILED DESCRIPTION OF THE PREFERRED EMBODIMENTS

Referring now to the FIGURE, it should first be understood that "green" bodies are formed in accordance with the prior art as set forth in the above described patents and applications or otherwise and do not form a part of this invention.

As can be seen with reference to the FIGURE, a "green" body 1 is placed on a wick 3 in an oven 5, the wick being positioned on a support table 7 within the oven. The wick 3 may be permeable to permit evaporation from all surfaces thereof. The oven has an air inlet port 9 and an exhaust port 11. A blower 13 is positioned at the entrance to the inlet port 9 and blows atmosphere which is unsaturated as to binder content over a heater 15 which is controlled by a temperature controller 17 to provide proper heating within the oven. The temperature controller 17 can also be responsive to a further temperature measuring device 19 positioned within the oven and closely adjacent the "green" body 1 to insure that the temperature of the "green" body is at the desired level.

Unsaturated air of other appropriate atmospheres will enter the system by the inlet 21 through a valve 23 which controls the amount of inlet air and then travels to the blower 13 which blows the air over the heater 15 and into the oven 5 at high speed to maintain the desired oven temperature and to provide turbulent air flow over the "green" body 1 and the wick 3. The air from the oven with binder vapors therein and other chemical reaction products then exits from the oven through the exhaust port 11 and all of this exhaust air is recirculated through the recirculating air line 25 to mix with inlet air. The exhaust air with binder vapors and chemical reaction products therein can either be exhausted to the atmosphere as shown in FIG. 1 of U.S. Pat. No. 4,404,166 or it can be condensed in a proper condenser by lowering the temperature thereof whereby the binder vapors can be condensed and recovered for reuse as will be described hereinbelow.

The system also includes a source of hydrogen 29 which is fed to the oven 5 through a controlled valve 31 under control of a controller 33. The controller 33 is responsive to the temperature in the oven 5 and therefore can be responsive to a temperature measuring element (not shown) within the oven or to the temperature measured by the temperature measuring device 19. Also shown are a source of argon 35 controlled by a control valve 37 under control of a controller 33 as well as a source of water or steam 39 controlled by the control valve 41 which is also under control of the controller 33. The water, in liquid or gaseous form, enters the exhaust port 11 and vaporizes, if in liquid form. Since the water is below the vaporizing temperature of the binder vapors and chemical reaction products in the effluent in port 11, it causes them to condense and pass through the spout 44 at the base of port 11 into the tank 45 due to the negative pressure induced by blower 27. Effluent gas also travels through spout 11 due to action of blower 27, this gas being replaced by fresh inlet air at inlet 21. The valve 42 can be closed to prevent gas recirculation in air line 25.

EXAMPLE 1

3150 grams of substantially spherical nickel particulate material having an average size of 4 to 7 micron diameter and a specific surface area of 3.4 square meters per gram (Inco type 123 nickel powder) was mixed with 352 grams of binder which included 70 grams of polypropylene which goes from the crystalline to the liquid state at about 150° C., 35 grams of carnauba wax having a melting point of about 85° C. and 247 grams of paraffin having a melting point of about 50° C. The mixture was placed into a double arm dispersion type mixer of one quart capacity and mixed at a temperature of 170° C. until the polypropylene incorporated itself into the mixture. The temperature was then lowered to 150° C. for one half hour while still mixing. A homogeneous uniform and modest viscosity plastisole was formed. The plastisole was removed from the mixer and allowed to cool for an hour until the binder system had solidified. The hardened material was broken up by a plastic grinder and the pieces were placed into an injection molding machine of 1½ ounce capacity. Nine hundred rings were formed in the injection molding machine. The rings were placed and densely stacked on cordierite setters coated with a thin layer of alumina powder to prevent sticking in a laboratory oven, which is schematically shown in the FIGURE, and the temperature was rapidly raised from ambient temperature to the melting point of a portion of the binder system (145° C.) over a period of 9 minutes with an atmosphere of air being injected at the inlet 21. The temperature over the next two hours was raised to 205° C. this being above the melting point of the highest temperature melting point component of the binder, to make same fluid and held at that temperature for a one hour soak. The valve 41 was opened when the temperature in the oven reached 130° C. under control of the controller 33 which is responsive to the temperaure sensor 19 to permit water from the water source 39 to contact the recirculated oven exhaust, part of the water evaporating and recirculating along with the oven effluent to water saturate the oven interior. The remaining water, which is at 100° C., is sufficiently cool to condense and entrain the binder and flow with the entrained binder through outlet spout 44 to collection tank 45. Blower 27 induces a negative pressure on tank 45 which is transferred through spout 44 into duct system 25, thereby drawing fresh inlet air through inlet 21. The temperature was then raised in the course of the next 5 hours to 205° C. The valve 23 was then closed to shut off the air, the valve 37 was opened to permit argon to replace the air atmosphere portion and the recirculation valve 42 was closed, all under control of controller 17 to purge the air out of the oven 5. The temperature was then raised to 735° C. over a prior of four hours. At 370° C., the valve 31 was opened to permit hydrogen from the hydrogen source 29 to enter into the oven 5. The 735° C. was maintained for two hours with the hydrogen portion of the atmosphere being raised during this period to 60% by volume. The valve 41 was then closed to shut off the flow of water since all carbon which had been formed would have been converted to carbon monoxide, methane and water vapor. The large amount of hydrogen in the system prevents any further oxidation by providing a reducing atmosphere and reduces the oxidized surfaces of the fine particles. The temperature was then raised to 1250° C. over a period of four hours to provide sintering of the particles and the oven was then turned off and remained closed until the temperature therein had been lowered to 80° C. whereupon the valves 31 and 37 were closed to shut off the hydrogen and argon supplies, the valve 43 was closed to prevent migration of air back into the oven and the oven was then opened. The parts in the oven were inspected and found to be completely sintered with no carbon buildup on the surface or within the parts themselves. When the interior portions of the oven and associated valves and plumbing were inspected, they were found to be free from residual binder deposits.

EXAMPLE 2

The above noted procedure was repeated except that the valve 41 was held closed during the entire operation, thereby preventing water vapor or water from entering into the oven 5. After the processing procedure had been completed the parts in the oven were inspected and found to contain large portions of carbon both on the surfaces thereof as well as within the bodies of the parts themselves. The parts were deformed.

EXAMPLE 3

Example 1 was repeated except that 1575 grams of the nickel were used along with 1575 grams of substantially spherical iron of average particle diameter 4 to 6 microns in place of the additional nickel of Example 1. The results were the same as set forth in Example 1.

EXAMPLE 4

Example 2 was repeated except that the particulate material thereof was replaced with the particulate material of Example 3. The results were the same as set forth in Example 2.

EXAMPLE 5

Example 1 was repeated except that 3150 grams of aluminum oxide of average particle diameter 0.2 to 0.3 microns was used in place of the nickel of Example 1, the sintering temperature was 1560° C. and a standard atmosphere replaced the hydrogen. The results were the same as set forth in Example 1.

EXAMPLE 6

Example 2 was repeated except that the particulate material thereof was replaced with the particulate material of Example 5 and the sintering conditions were those set forth in Example 5. The results were the same as set forth in Example 2.

Though the invention has been described with respect to specific preferred embodiments thereof, many variations and modifications will immediately become apparent to those skilled in the art. It is therefore the intention that the appended claims be interpreted as broadly as possible in view of the prior art to include all such variations and modifications.

I claim:

1. A method of producing an article from a fired particulate configuration whereby binder material is removed from the particulate configuration prior to firing without swelling the particulate configuration and consequent imparting of sheer or tensile force to the particulate configuration prior to the firing thereof, wherein said configuration is formed by mixing together predetermined amounts of sinterable particulate material and binder whereby the binder covers substantially all of the surface of the particles of said particulate material and forming said mixture into a desired configuration, comprising the steps of:

(a) heating said configuration to a temperature above the flow point of at least a portion of said binder, (b) substantially saturating the atmosphere contacting the exposed surfaces of said configuration with water vapor after the temperature of the surface of said configuration is above 100° C., (c) moving said water saturated atmosphere over and in contact with said configuration, (d) elevating the temperature of said configuration with a predetermined temperature-time profile to a level below the sintering temperature of said particulate material to remove remaining binder from said configuration, (e) providing an atmosphere contacting said configuration suitable to the sintering requirements of said configuration; and (f) raising the temperature of said configuration according to a predetermined temperature-time profile to sinter said stripped and formed configuration.

2. A method as set forth in claim 1 wherein said particulate material is taken from the class consisting or metals and cermets further including providing a net reducing atmosphere contacting the exposed surfaces of said configuration during step (d).

3. A method as set forth in claim 1 wherein said atmosphere in step (b) includes air and said temperature in step (b) is about 130° to 140° C.

4. A method as set forth in claim 2 wherein said atmosphere in step (b) includes air and said temperature in step (b) is about 130° to 140° C.

5. A method as set forth in claim 2 wherein step (e) comprises adding a reducing agent to said atmosphere.

6. A method as set forth in claim 4 wherein step (e) comprises adding a reducing agent to said atmosphere.

7. A method as set forth in claim 2 wherein said reducing agent is hydrogen.

8. A method as set forth in claim 4 wherein said reducing agent is hydrogen.

9. A method as set forth in claim 5 wherein said reducing agent is hydrogen.

10. A method as set forth in claim 6 wherein said reducing agent is hydrogen.

11. A method of producing an article from a fired particulate configuration whereby binder material is removed from the particulate configuration prior to firing without swelling the particulate configuration and consequent imparting of sheer or tensile force to the particulate configuration prior to the firing thereof, wherein said configuration is formed by mixing together predetermined amouts of sinterable particulate material and binder whereby the binder covers substantially all of the surface of the particles of said particulate material and forming said mixture into a desired configuration, comprising the steps of:

(a) providing an enclosure having an air atmosphere,
(b) placing said configuration in said enclosure,
(c) heating said configuration to a temperature above the flow point of at least a portion of said binder,
(d) substantially saturating said atmosphere with water vapor after said configuration has been heated to a temperature in excess of 100° C.,
(e) causing said atmosphere to flow over and contact the surface of said configuration,
(f) elevating the temperature of said configuration with a predetermined temperature-time profile to a level below the sintering temperature of said particulate material to remove remaining binder from said configuration,
(g) providing an atmosphere containing said configuration suitable to the sintering requirements of said configuration; and
(h) raising the temperature of said configuration according to a predetermined temperature-time profile to sinter said configuration.

12. A method as set forth in claim 11 wherein said particulate material is taken from the class consisting or metals and cermets further including providing a net reducing atmosphere contacting the exposed surfaces of said configuration during step (f).

13. A method as set forth in claim 12 wherein step (h) is carried out in a reducing atmosphere.

14. A method as set forth in claim 12 wherein said reducing atmosphere is hydrogen.

15. A method as set forth in claim 13 wherein said reducing atmosphere is hydrogen.

16. A method as set forth in claim 14 wherein said atmosphere is about 60% hydrogen by volume.

17. A method as set forth in claim 15 wherein said atmosphere is about 60% hydrogen by volume.

* * * * *